US011147347B2

(12) United States Patent
Mong

(10) Patent No.: US 11,147,347 B2
(45) Date of Patent: Oct. 19, 2021

(54) ESSENTIAL OIL-CONTAINING RING

(71) Applicant: Gemtown (Shenzhen) Holding Company Limited, Shenzhen (CN)

(72) Inventor: Wai Hung Anthony Mong, Guangdong (CN)

(73) Assignee: Gemtown (Shenzhen) Holding Company limited, Shenzhen (CN)

( * ) Notice: Subject to any disclaimer, the term of this patent is extended or adjusted under 35 U.S.C. 154(b) by 120 days.

(21) Appl. No.: 16/521,881

(22) Filed: Jul. 25, 2019

(65) Prior Publication Data

US 2021/0022458 A1 Jan. 28, 2021

(30) Foreign Application Priority Data

Jul. 23, 2019 (CN) ..... 201921157551.3

(51) Int. Cl.
*A44C 9/00* (2006.01)
*A44C 17/02* (2006.01)
*A44C 9/02* (2006.01)

(52) U.S. Cl.
CPC ..... *A44C 9/0061* (2013.01); *A44C 9/02* (2013.01); *A44C 17/0208* (2013.01)

(58) Field of Classification Search
CPC ... A44C 9/0053; A44C 9/0061; A44C 9/0069; A44C 9/02; A44C 15/002
USPC ..... 63/1.14, 1.15, 15.45, 15.5, 15
See application file for complete search history.

(56) References Cited

U.S. PATENT DOCUMENTS 8,196,428 B2 * 6/2012 Meltzer ..... A44C 17/0233 63/29.1
2010/0223953 A1 * 9/2010 Juan ..... A44C 15/002 63/1.15
2016/0174670 A1 * 6/2016 McAlarney ..... A44C 17/0233 63/1.13

* cited by examiner

*Primary Examiner* — Jack W Lavinder

(57) ABSTRACT

The present invention provides an essential oil-containing ring, comprising a ring body that is adjustable in size, a jewel provided on the ring body, a fixing member provided on the ring body and connected to one end of the jewel, a container component detachably provided at the other end of the jewel, and an essential oil contained in the container component to emit fragrance. The essential oil placed in a container in the ring can emit the fragrance through the joint gap. The ring of the present invention is provided with an opening at the ring body, so that the size of the ring can be adjusted according to different finger sizes as required.

12 Claims, 7 Drawing Sheets

ESSENTIAL OIL-CONTAINING RING

CROSS-REFERENCE TO RELATED APPLICATIONS

This application claims the benefit of priority from Hongkong Patent Application No. 19126937.2, filed on Jul. 17, 2019. The content of the aforementioned application, including any intervening amendments thereto, is incorporated herein by reference in its entirety.

TECHNICAL FIELD

The present invention relates to jewelry, and more particular to a ring which emits the long-lasting fragrance.

BACKGROUND OF THE INVENTION

Known rings are usually set with some accessories on the bands, such as jewels or diamonds and made into different shapes and colors to increase the attractiveness of rings. However, as the techniques for manufacturing rings matures, the manufacturing process and styling of the rings have encountered a bottleneck, so it is difficult to make a popular ring by improving the shapes or colors of rings.

A new trend for improvement on the existing rings is the addition of fragrance. For example, Chinese Patent No. CN2275384 Y discloses a ring capable of emitting fragrance, in which a cavity lined with perfume pieces is provided in the ring body, and a box cover attached to the cavity are provided with through holes of the same shape. The lower cover is connected to the upper cover at a center thereof via a shaft. A side of the cover box is provided with a slot in which a pull pin connected to the lower cover is provided, such that the upper cover is integrated with the cover box. The ring disclosed in this patent is characterized by certain perfumes placed in the corresponding part additionally arranged on the ring. However, such ring is less popular since the fragrance from the perfumes is not long-lasting and the perfumes are not easily replaced. The ring of the present invention that is simply to wear can not only be used as an ornament, but gives off fragrance and other herb scents as needed.

Therefore, there is a need to improve the existing techniques and products to provide a novel ring, which has a similar shape with existing rings and accessories thereof and release the fragrance for a long time, such that it tends to be popular.

SUMMARY OF THE INVENTION

The present invention aims to provide a novel ring, which has a similar shape with the existing rings and accessories and release the fragrance for a long time, such that it tends to be popular.

In order to achieve the above purpose, the present invention adopts the following technical solutions.

An essential oil-containing ring, comprising:

a ring body that is adjustable in size;

a jewel provided on the ring body;

a fixing member provided on the ring body and connected to one end of the jewel for fixing the jewel to the ring body;

a container component; and an essential oil contained in the container component to emit fragrance.

An opening is provided on the ring body to adjust a diameter of the ring body.

In an embodiment, the jewel comprises an amethyst, a white crystal, a pearl or a gemstone; and a cross-section of the jewel is a circle, a square, a hexagon, an octagon or in any other shape.

In an embodiment, the fixing member is a fixing nail.

In an embodiment, the ring body has a flat surface on which the fixing nail is provided.

In an embodiment, the container component comprises a container and a fixing end. The container is placed in a space pre-arranged in the jewel, and is fixed by the fixing end.

In an embodiment, the fixing end is provided with a first thread to match with a thread on the jewel.

In an embodiment, the container comprises a container body which has an opening at one end, and a flange extending outwardly is provided at the opening of the container body.

In an embodiment, the flange is provided with a cap which is connected to the flange in a snap-fit manner.

In an embodiment, a connecting member is provided between the cap and the container body, and the connector is provided with a second thread to fix the connector to the container body.

In an embodiment, the connecting member is provided with a through hole.

The jewel or gemstone on the essential oil-containing ring of the present invention can be made into different shapes to solve the problem of monotonous shapes in prior art, improving aesthetic impressions.

The essential oil placed in the container in the ring can emit the fragrance through the joint gap. The fragrance can last for a long time due to ingredients and compositions of the essential oil. Moreover, when the essential oil is run out, a drop of the essential oil is added into the container body only by unscrewing the screw. The whole process is simple and convenient, and the ring is reusable.

Moreover, the ring of the present invention is provided with an opening on the ring body, so that the size of the ring can be adjusted to fit fingers of different sizes as required.

BRIEF DESCRIPTION OF THE DRAWINGS

The present invention will be further described in detail with reference to the accompanying drawings.

DETAILED DESCRIPTION OF EMBODIMENTS

Figure 1:
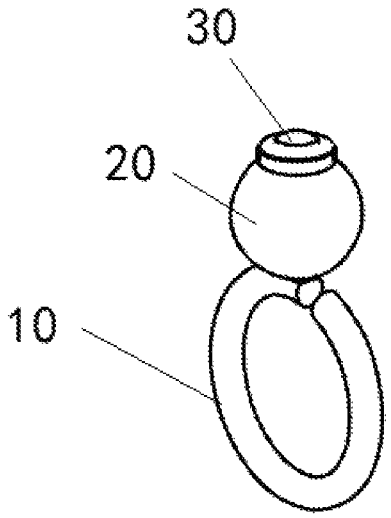
FIG. 1 is a schematic diagram of an essential oil-containing ring with a round pearl according to an embodiment of the present invention.
Figure 2:
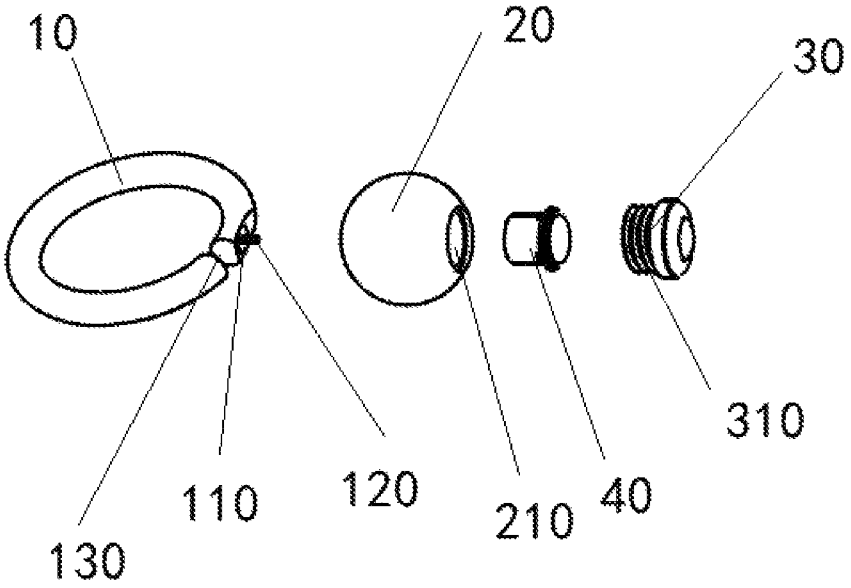
FIG. 2 is an exploded view of the essential oil-containing ring of FIG. 1.

As shown in FIGS. 1-2, this embodiment illustrates an essential oil-containing ring comprising a ring body 10, a jewel 20 and a container component.

The ring body 10 is adjustable in size by providing an opening 130 to fit fingers of various sizes. Preferably, the ring body has a flat surface 110 on which a fixing member is provided. A fixing hole is provided on the jewel 20, so that the jewel 20 is fixed to the ring body 10 via the fixing member. Generally, the opening 130 is positioned adjacent to the flat surface 110. Further, the fixing member is a fixing nail. Preferably, the flat surface 110 is a circular plane having a diameter of 2.5 mm.

Preferably, the jewel 20 comprises an amethyst, a white crystal, a pearl, a gemstone or any one of other jewels or diamonds. In an embodiment, a cross-section of the jewel 20 is a circle, a square, a hexagon, an octagon or in any other shapes.

Figure 3:
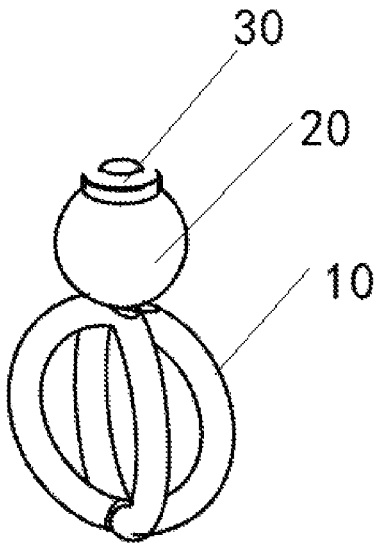
FIG. 3 is a schematic diagram of the essential oil-containing ring with a double-band body according to another embodiment of the present invention.
Figure 4:
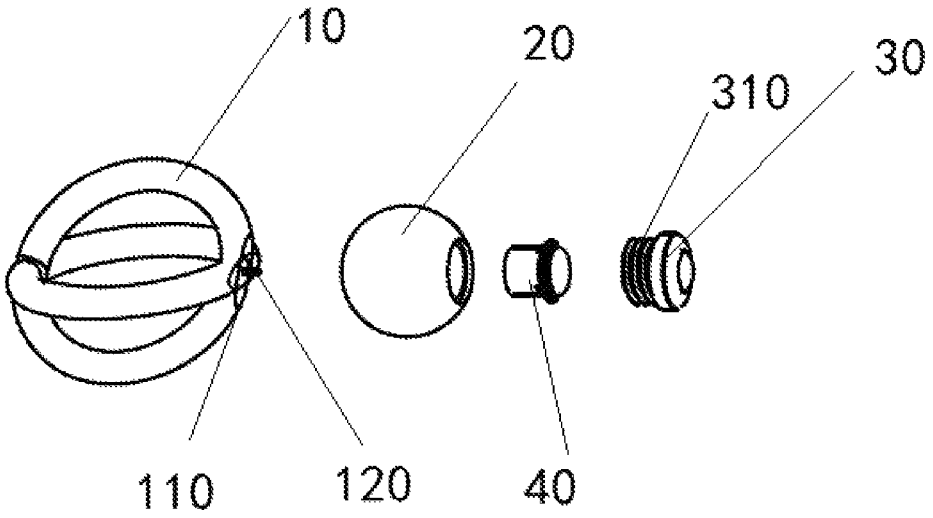
FIG. 4 is an exploded view of the essential oil-containing ring of FIG. 3.

As shown in FIGS. 3 and 4, according to another embodiment of the present invention, the ring is similar to the above embodiment, except that the ring body 10 is double-band. The double-band ring body creates a different visual impression and improves the aesthetic attractiveness of the ring.

Figure 5:
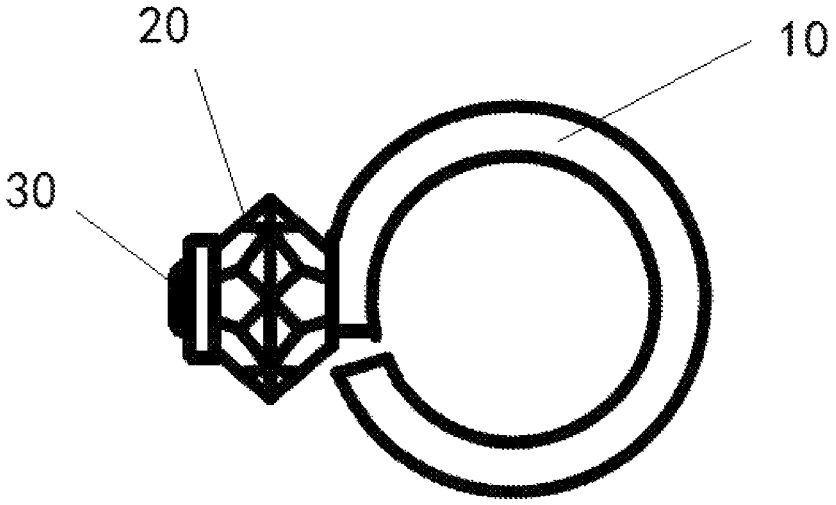
FIG. 5 is a schematic diagram of the essential oil-containing ring with a white hexagonal prism crystal according to yet another embodiment of the present invention.
Figure 6:
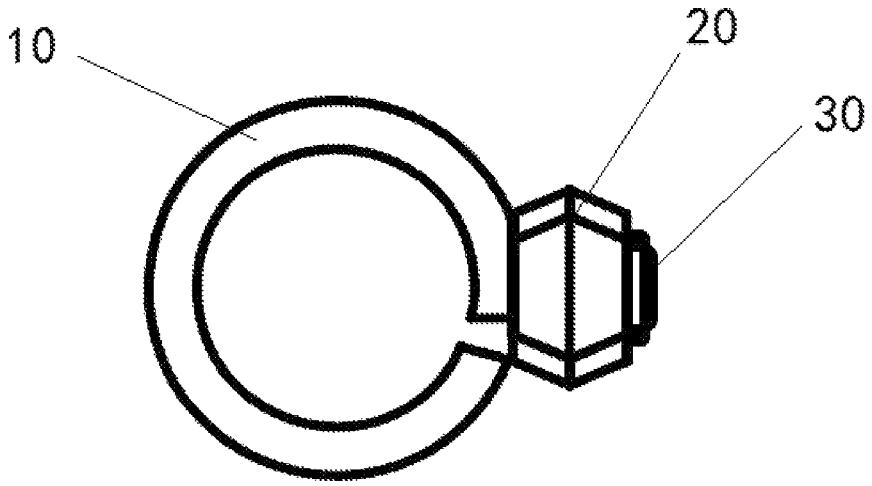
FIG. 6 is a schematic diagram of the essential oil-containing ring with a pink quadrilateral crystal according to still another embodiment of the present invention.

As shown in FIG. 5, according to another embodiment of the present invention, the jewel 20 provided on the essential oil-containing ring is a white hexagonal prism crystal. As shown in FIG. 6, according to another embodiment of the present invention, the jewel 20 provided on the essential oil-containing ring is a pink quadrilateral crystal. Rings with different jewels differ in price and aesthetic impressions, thus providing more choices for different customers. Shapes and styles of the jewel 20 can be altered at will.

Figure 7:
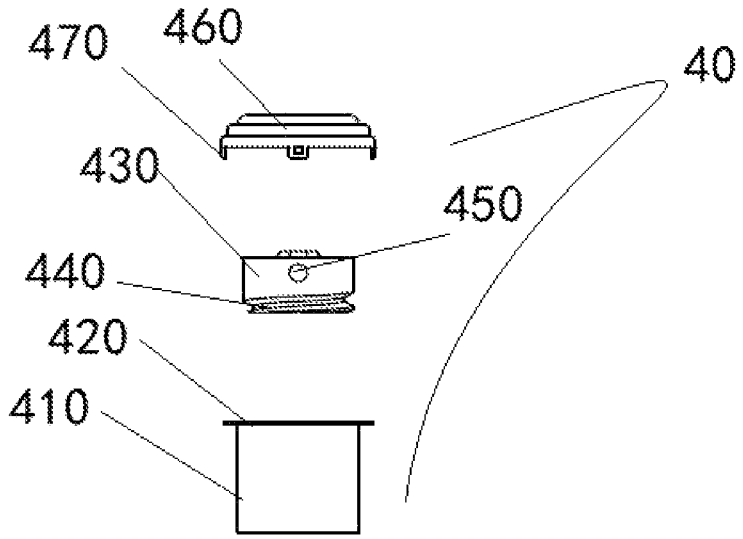
FIG. 7 is an exploded view of a container component of the essential oil-containing ring.

As shown in FIGS. 2 and 7, the ring of the present invention further comprises a container component that is detachably provided in the jewel 20. The essential oil is provided in the container component to emit fragrance.

A hole 210 is arranged in the jewel 20 to place the container component comprising a container 4 and a fixing end 30. The container 40 is provided in a hole 210 pre-arranged in the jewel, and is fixed by the fixing end 30. In an embodiment, the fixing end 30 is provided with a first thread 310 to match with a thread on the jewel, so that the fixing end and the jewel are fixed together.

The container 40 comprises a container body 410 which has an opening at one end, and a flange 420 extending outwardly is provided at the opening of the container body 410. The container body 410 serves to contain the essential oil. A cap 460 is provided on the container body 410, and is connected to the flange 420 via a plurality of fasteners 470 in a snap-fit manner.

Further, a connecting member 430 is provided between the cap 460 and the container body 410, and the connecting member 430 is provided with a second thread 440 to fix the connecting member to the container body 410, enabling a stable connection therebetween.

The second thread 440 is sufficiently short for a larger space of the container body 410, as long as the connecting member and the container body can be fixed.

Further, the connecting member is provided with a through hole 450 to connect with a silver head.

In an embodiment, the cap 460 is made of silver, such as 925 sterling silver, and the container body 410 and the connecting member 430 are made of aluminum alloy. Materials may be selected according to cost or other factors to obtain the final products with different qualities and prices.

Therefore, the jewel or gemstone on the ring of the present invention can be made into different shapes to solve the problem of monotonous shapes in the prior art, thus improving the aesthetic impressions of the ring.

The essential oil placed in the container body of the ring can emit fragrance through a joint gap, and the fragrance can last for a long time due to the ingredients and compositions of the essential oils. Moreover, when the essential oil is run out, a drop of the essential oil can be added into the container only by unscrewing. The whole operation is simple and easy, and the ring is reusable.

The ring of the present invention is provided with an opening at the ring body, so that the size of the ring can be adjusted to fit different finger sizes as required.

What is claimed is:

1. An essential oil-containing ring, comprising:

a ring body that is adjustable in size;

a jewel provided on the ring body;

a fixing member provided on the ring body and connected to one end of the jewel for fixing the jewel to the ring body;

a container component detachably provided at the other end of the jewel; and an essential oil contained in the container component to emit fragrance.

2. The ring of claim 1, wherein an opening is provided on the ring body to adjust a diameter of the ring body.

3. The ring of claim 1, wherein the jewel comprises an amethyst, a white crystal, a pearl or a gemstone.

4. The ring of claim 1, wherein a cross-section of the jewel comprises a circle, a square, a hexagon or an octagon.

5. The ring of claim 1, wherein the fixing member is a fixing nail.

6. The ring of claim 5, wherein the ring body has a flat surface on which the fixing nail is provided.

7. The ring of claim 1, wherein the container component comprises a container and a fixing end; the container is placed in a space pre-arranged in the jewel, and is fixed by the fixing end.

8. The ring of claim 7, wherein the fixing end is provided with a first thread to match with a thread on the jewel.

9. The ring of claim 7, wherein the container comprises a container body which has an opening at one end; and a flange extending outwardly is provided at the opening.

10. The ring of claim 9, wherein the flange is provided with a cap which is connected to the flange in a snap-fit manner.

11. The ring of claim 9, wherein a connecting member is provided between the cap and the container body, and the connecting member is provided with a second thread to fix the connecting member to the container body.

12. The ring of claim 11, wherein the connecting member is provided with a through hole.

* * * * *